US007174591B2

(12) United States Patent
Bertrand et al.

(10) Patent No.: US 7,174,591 B2
(45) Date of Patent: Feb. 13, 2007

(54) SYSTEM FOR BRIDGE-LAYING

(75) Inventors: Ludovic Bertrand, Guyancourt (FR); Marc Chassillan, Les Clayes sous Bois (FR); Benoît Chapouthier, Montigny le Bretonneux (FR)

(73) Assignee: Giat Industries, Versailles (FR)

( * ) Notice: Subject to any disclaimer, the term of this patent is extended or adjusted under 35 U.S.C. 154(b) by 0 days.

(21) Appl. No.: 10/542,977

(22) PCT Filed: Jan. 22, 2003

(86) PCT No.: PCT/FR03/00213

§ 371 (c)(1),
(2), (4) Date: Dec. 21, 2005

(87) PCT Pub. No.: WO2004/074580

PCT Pub. Date: Sep. 2, 2004

(65) Prior Publication Data

US 2006/0137113 A1 Jun. 29, 2006

(51) Int. Cl.
*E01D 15/127* (2006.01)
*E01D 15/22* (2006.01)

(52) U.S. Cl. ..... 14/2.5; 14/2.4

(58) Field of Classification Search ..... 14/2.4, 14/2.5, 2.6, 77.1, 78
See application file for complete search history.

(56) References Cited

U.S. PATENT DOCUMENTS

| | | | | |
|---|---|---|---|---|
| 3,134,116 | A | 5/1964 | Adkins et al. | 14/1 |
| 3,881,147 | A * | 4/1975 | Ueda et al. | 363/57 |
| 4,493,122 | A * | 1/1985 | Echtler et al. | 14/2.4 |
| 4,602,399 | A | 7/1986 | Jenkins | 14/2.4 |
| 4,635,311 | A * | 1/1987 | Helmke | 14/2.5 |
| 4,663,793 | A * | 5/1987 | Parramore | 14/2.5 |
| 5,276,930 | A * | 1/1994 | Parramore | 14/2.5 |
| 5,507,057 | A * | 4/1996 | Diefendahl et al. | 14/2.4 |
| 5,526,544 | A * | 6/1996 | Wiedeck et al. | 14/2.4 |
| 6,611,982 | B2 * | 9/2003 | Eberl et al. | 14/2.5 |

FOREIGN PATENT DOCUMENTS

| | | | |
|---|---|---|---|
| FR | 2502659 | A1 | 10/1982 |
| FR | 2834524 | A1 | 7/2003 |
| GB | 2374370 | A * | 10/2002 |

* cited by examiner

*Primary Examiner*—Raymond Addie
(74) *Attorney, Agent, or Firm*—Steptoe & Johnson LLP

(57) ABSTRACT

A system to lay a bridge between two banks, wherein said system firstly comprises a bridge carrying vehicle constituted by a remote-controlled self-propelled platform incorporating means to deploy and retract said bridge, said platform being unmanned and armor-free, and secondly a control post comprising means to communicate with said platform.

9 Claims, 4 Drawing Sheets

SYSTEM FOR BRIDGE-LAYING

BACKGROUND OF THE INVENTION

1. Field of the Invention

The technical scope of the present invention is that of systems enabling the deployment of a modular bridge carried by a vehicle, able to be deployed over an obstacle to allow vehicles to get across.

2. Description of the Related Art

To cross a river, a ford or a ditch, it is well known to use a vehicle carrying girders that are to be deployed over the obstacle. The vehicle is namely equipped with means enabling the bridge to be deployed, motorization ensuring its autonomy on the field of operations and means reinforcing its resistance to attacks by various projectiles. It is thus generally a heavy and cumbersome vehicle, difficult to manoeuvre and only able to be used in zones of relatively easy access.

By way of example, reference may be made to French patents 2 637 300, 2 637 301, 2 731 447 and 2 731 448 in the name of the applicant.

All the bridges illustrated by these patents are generally carried by armored vehicles to ensure the protection of the crew and are of imposing mass.

SUMMARY OF THE INVENTION

The aim of the present invention is to supply a bridge laying system, for example a modular bridge, that only requires light, autonomous, remote-controlled means.

The invention thus relates to a system to lay a bridge between two banks, wherein it firstly comprises a bridge carrying vehicle constituted by a remote-controlled self-propelled platform incorporating means to deploy and retract the bridge, said platform being unmanned and armor-free, and secondly a control post comprising means to communicate with said platform.

According to one characteristic of the invention, the platform is motorized thus ensuring its autonomy over any terrain at a distance from the control post, such motorization being provided, for example, by a diesel engine.

According to another characteristic of the invention, the platform is of the tracked or wheeled type or is a combination of both.

Advantageously, the platform incorporates means to implement the bridge.

According to yet another characteristic of the invention, the platform comprises control means able to be actuated at a distance from a control post.

According to yet another characteristic of the invention, the communication means are constituted by a steering data transmission system for the platform and a system to control the bridge implementing means.

Advantageously, the communication means are of the fixed, ultrasound, sound, luminous beam, infrared link or radio wave type.

According to another characteristic of the invention, the platform is towed by a vehicle to the site the bridge is to be deployed.

According to yet another characteristic of the invention, the control post is located in an armored vehicle or technical shelter.

A first advantage of the system according to the invention lies in the safety it provides for the crew. Indeed, the platform carries no operators and its possible destruction does not endanger the crew.

Another advantage lies in the simplified design and production of the platform which no longer has to be protected against projectiles.

Yet another advantage lies in the fact that the platform may be produced using commercially-available components which don't have to be specifically designed for this type of military plant.

BRIEF DESCRIPTION OF THE DRAWINGS

Other characteristics, details and advantages of the invention will become more apparent from the description given hereafter by way of illustration in reference to the appended drawings, in which.

DETAILED DESCRIPTION OF PREFERRED EMBODIMENTS

Bridge carrying vehicles currently used in the army are constituted by a self-propelled chassis with a crew of at least two. The protection constraints for the on-board crew generate masses of around 60 tons for a tracked vehicle and 50 tons for a wheeled vehicle. It is easy to understand that such vehicles require substantial motorization.

Both the mass and the high level of performance and cross-country mobility required means that in the design of these vehicles, specific components have to be created. Moreover, since the need for this type of equipment is not great, the production of new equipment is ruled out.

Figure 1:
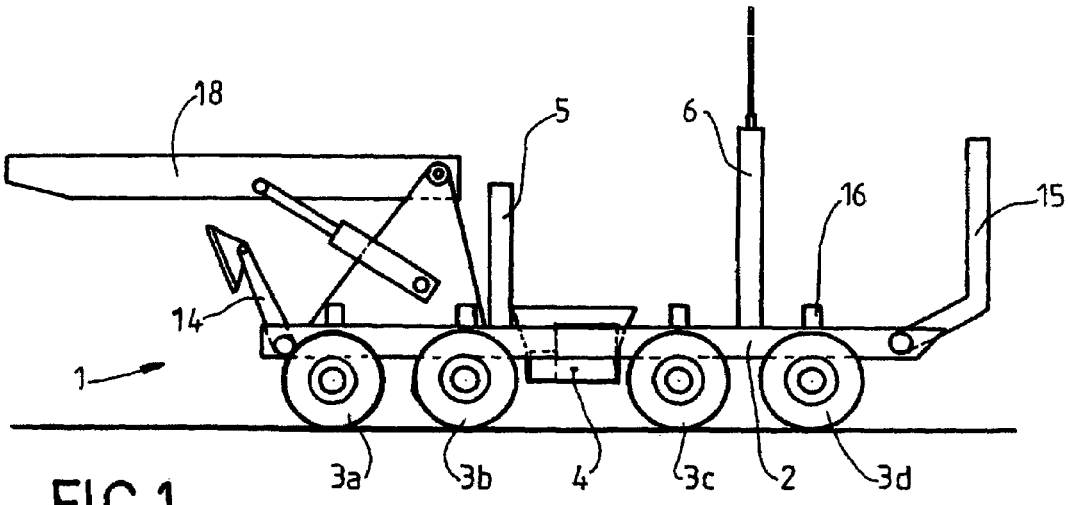
FIG. 1 is a side view of the platform.

FIG. 1 shows a side view of a platform 1 in the form of a vehicle composed of a chassis 2 motorized by eight wheels 3 (3*a* to 3*d*). A heat engine 4, of the diesel type, makes this platform mobile. As described previously, it goes without saying that the engine 4 enables the platform to be positioned as near as possible to the intervention site and makes it mobile over short distances. The platform is provided with reception and elevation means 5 and 6 placed at the two ends of the chassis and intended to receive the modular-type bridge. The Figure shows the spring parts 16 of the platform suspension and the stabilization elements 14 and 15.

The platform 1 is shown alone and it can be distanced from the bridge after laying. This platform can either be kept at a close distance if the girders are to be recovered or can be guided to a storage area.

Figure 2:
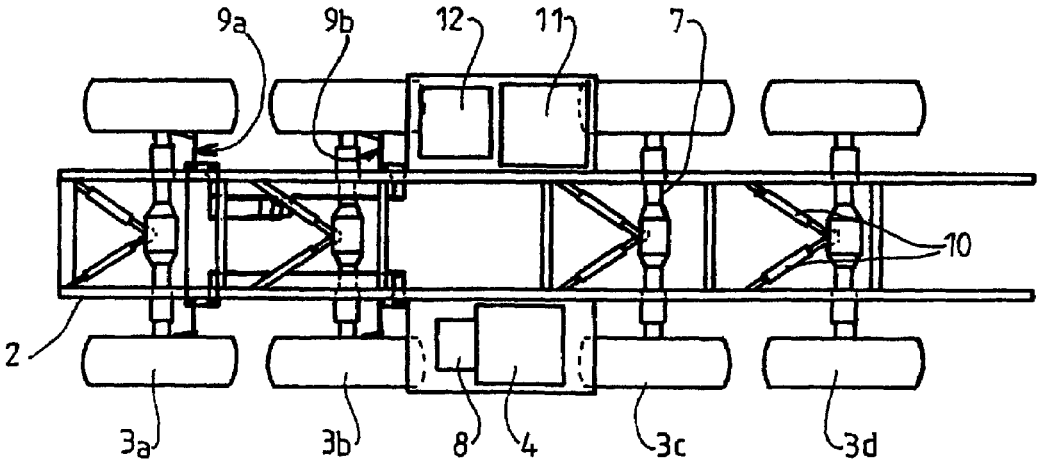
FIG. 2 is a top view of the platform.

FIG. 2 shows a top view of the platform 1 where the wheels 3*d* can be seen to be driven by the engine 4, a diesel engine for example, by means of a bridge 7 and in relation to a hydraulic pump 8, and wheels 3*a* and 3*b* are equipped with linkage 9*a* and 9*b* to ensure steering. The hydraulic pump 8 provides the drive autonomy of the platform 1 and the implementing of the bridge thanks to a hydraulic network, not shown. The platform 1 is also provided with suspension elements 10 connecting it to the different bridges.

The platform 1 also incorporates a radio system 11 for the transmission of steering and implementation control data and may also incorporate cameras (not shown) to monitor the terrain and the different maneuvers. These cameras must provide a full 360° C. field of vision around the platform. The radio system 11 is in relation with a remote reception and transmission unit 12.

Figure 9:
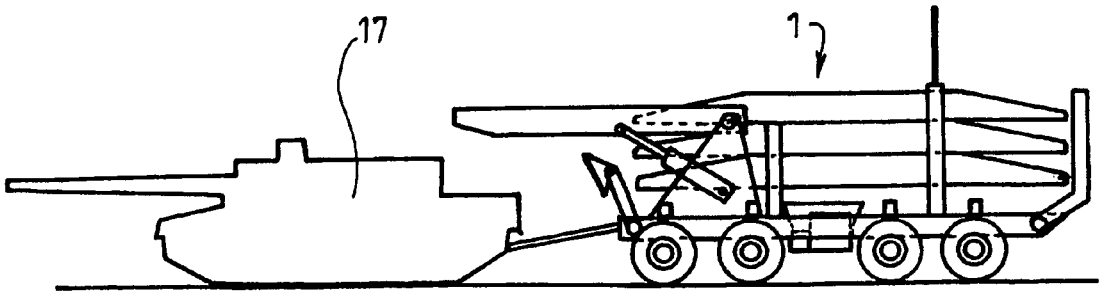
FIG. 9 shows a towed platform, and FIG. 10 schematically illustrates a control post.

To ensure the rapid transportation of this platform 1, it will be towed by an armored vehicle 17 or by a towing truck, as seen in FIG. 9. Naturally, these two means may be combined depending on the level of hostility. For its positioning on the bridging site, the platform 1 is autonomous and is able to move at a speed o around 15 km/h, for example, with the aid of the engine 4 cooperating with the hydraulic pump 8 in relation with the hydraulic motors that activate all or part of the wheels 3.

It is easy to understand that such a platform 1 obviates the need for on-board crew and thus the requirements linked to mobility, or ballistic, laser, nuclear and chemical protection, heat and air-conditioning are reduced.

Furthermore, such a platform 1 can be produced at a much lower cost than a vehicle equipped according to prior art, since the components used are those used, for example, on trucks. Thus, autonomy can be provided by means of a 150 CV engine. The platform 1 thus designed has a much reduced cost of ownership and may incorporate neither armored cab, nor NBC insulation, nor air-conditioning.

The platform 1 according to the invention, equipped with its modular bridge may be a piece of plant of around 25 tons, that is to say having a mass of half that of plant used up to date.

Figure 3:
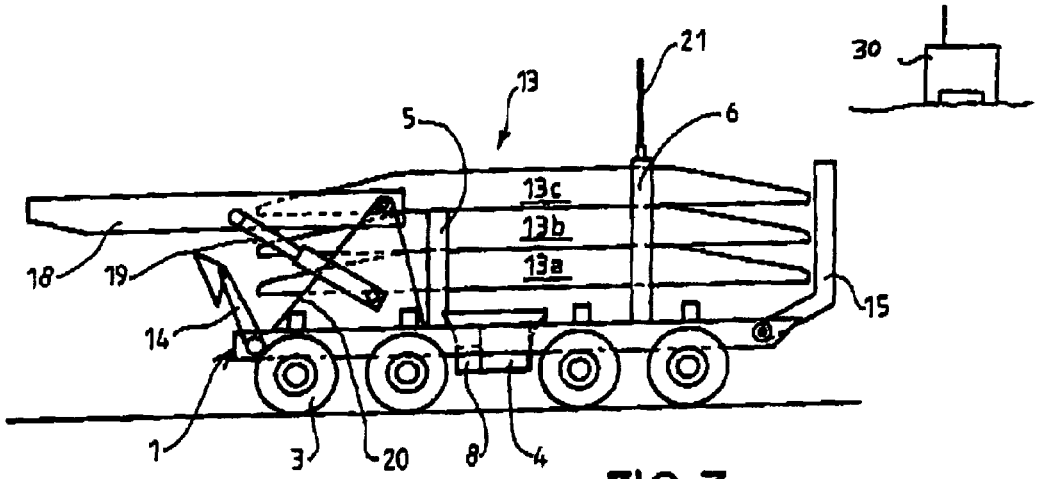
FIG. 3 is a side view of the platform equipped with the bridge.

FIG. 3 shows the platform 1 equipped with a bridge 13, for example modular, constituted of three girders 13*a*, 13*b*, 13*c*. The platform 1 also incorporates forward 14 and rear 15 stabilization means which must be lowered when the bridge elements 13*a*–13*c* are being maneuvered. The bridge elements 13*a*–13*c* are brought into the raised position one after the other by forward 16 and rear 17 lifting means part of the launching means 18 activated by a cylinder 19 integral with a support 20. The lifting means 17 may be extended by an antenna 21 that communicates with the control post.

FIGS. 4 to 8 show the positioning of the three bridge girders 13*a*–13*c* between banks 22 and 23. The stabilization elements 14 and 15 are first lowered to the ground and the platform's stabilization may be reinforced by an additional mass 24. The first girder 13*a* of the bridge 13 is made to slide (FIG. 5) above the launching means. If this bridge girder 13*a* is enough to span the banks, it is lowered to the round. If the banks are too far apart, the other two girders 13*b* and 13*c* are raised (FIG. 6) until girder 13*b* reaches the launching means 18. The girders 13*a* and 13*b* are connected together (FIG. 7) and may be used alone if the distance separating the banks has been spanned. The same process is used to bring the last girder 13*c* (FIG. 8) into position above the launching means 18 and girders 13*b* and 13*c* are connected together. The first girder is able to span distances of less than 9 m. Two girders are able to span distances of less than 17 m and three girders are able to span distances of less than 25 m.

Figure 10:
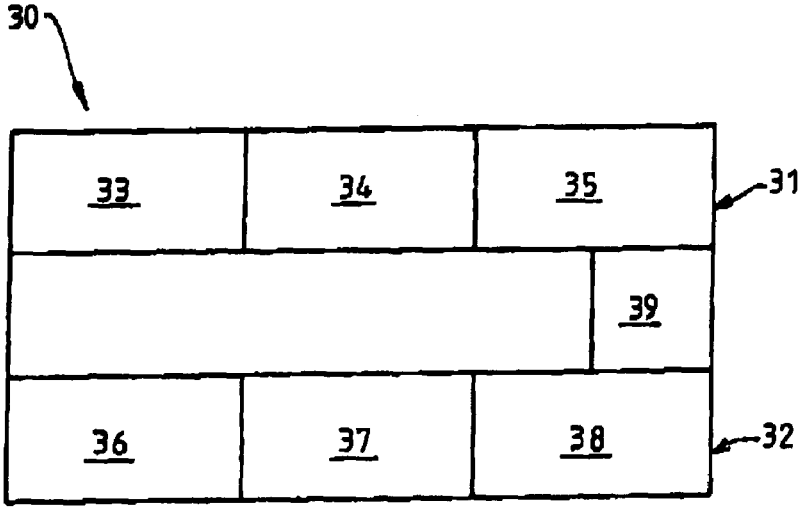
Figure 4:
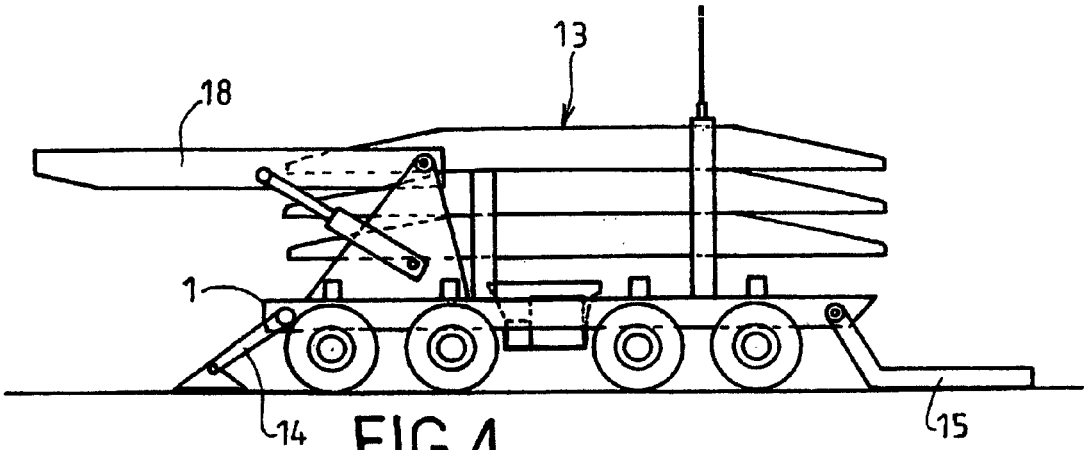
FIGS. 4 to 8 show the different bridge implementing phases using the platform.
Figure 5:
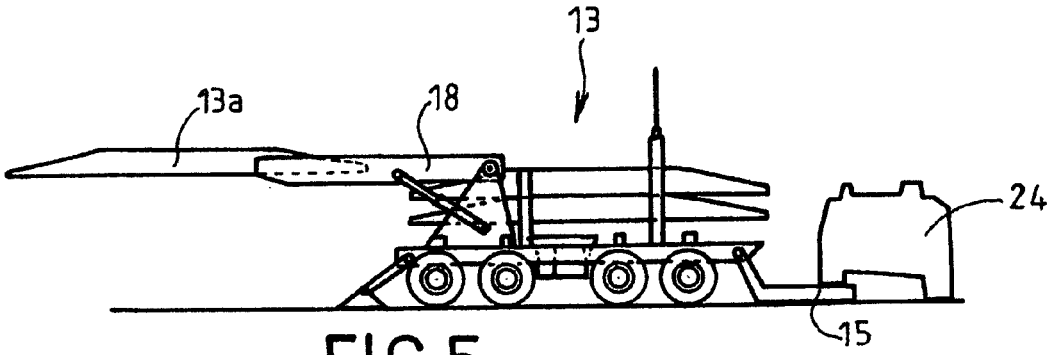
Figure 6:
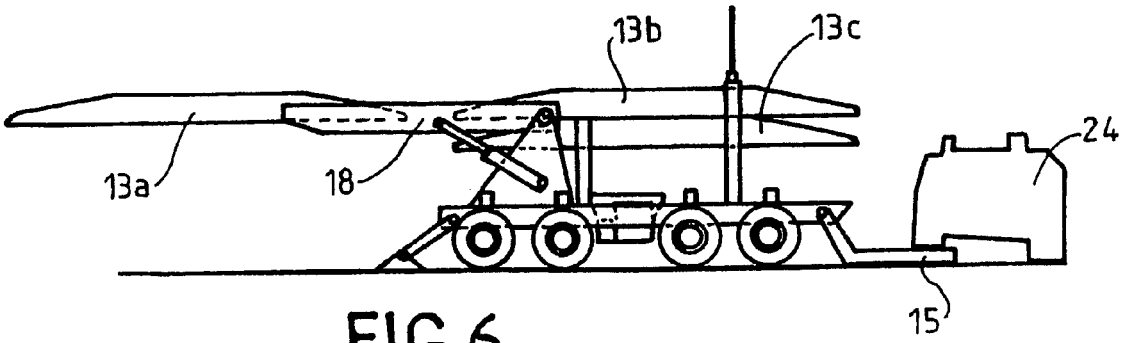
Figure 7:
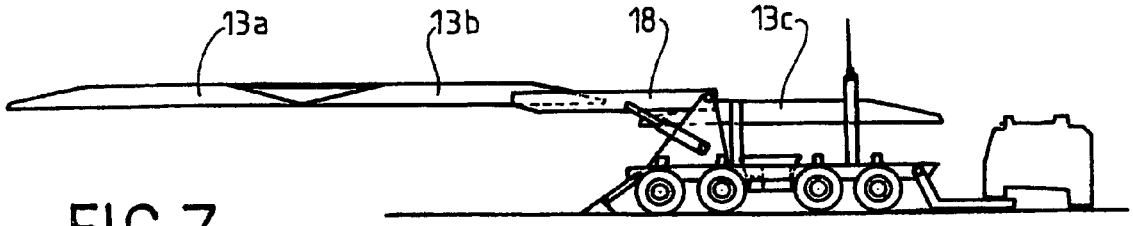
Figure 8:
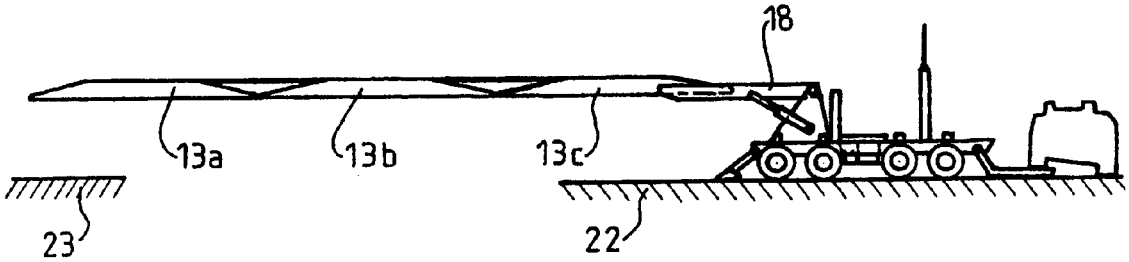

The remote-controlled implementation of the platform 1 is carried out using a control post 30 housed in a vehicle or technical shelter located at a distance behind the intervention site of the platform 1. This control post is thus protected and cannot be seen by any observers. This post, shown schematically in FIG. 10, is composed of a steering control post 31 and a command post 32.

Post 31 incorporates a monitoring screen 33, for example a video screen, the remote steering controls 34 for the platform to control movements backwards and forwards, steering lock in one direction, etc. and an implementation monitor 35 for the bridge used to control the different control means for the deployment of said bridge. This essentially requires the control of the cylinders in a known sequence in the bridge carrying vehicles.

Post 32 is constituted of a video screen 36 on which the platform control data is displayed, a cartography system 37 to guide the platform over the ground, and an implementation monitor 38 for the bridge as explained above.

Lastly, the control post 30 incorporates means 39 to radio transmit data to the platform 1 in relation with its corresponding means. Implementation is as follows. The platform 1, equipped with its bridge 13 and the control post 30, is brought and placed in the vicinity of the intervention site in a sheltered spot. A towing truck can both transport the post 30 and tow the platform. The control post 30 is set into position and the bridge is made ready for deployment. The platform 1 may be positioned a few hundred meters from the site. The platform 1 is then radio-guided until it reaches the bridge laying site. The deployment phases are then activated as explained in reference to FIGS. 4–8, said deployment being performed classically. The platform 1 is then distanced from the deployed bridge.

It goes without saying that the linking means between the post 30 and the platform may be fixed, sound, ultrasound, by luminous beam, infrared link or radio waves. The control post 30 may be on-board the towing vehicle. The platform 1 may itself be part of a girder or constitute an access ramp. Lastly, manual control means may be provided for the platform that can be used outside the operational site.

What is claimed is:

1. A system for laying a bridge between two banks, comprising:

a bridge carrying vehicle comprising a remote-controlled self-propelled platform having means to deploy and retract said bridge, said platform being unmanned and armor-free, and a control post located at a distance from said platform comprising means to communicate with said platform.

2. The system according to claim 1, said platform further comprising an engine for providing said platform with autonomy over any terrain at a distance from said control post.

3. The system according to claim 2, wherein said engine is a diesel engine.

4. The system according to claim 3, wherein said platform is selected from the group consisting of a tracked type, a wheeled type, and a wheeled-tracked combination type.

5. The system according to claim 4, said platform further comprising means to receive and raise said bridge.

6. The system according to claim 5, said platform further comprising control means able to be actuated at a distance from said control post.

7. The system according to claim 6, said communication means comprising a steering data transmission system for said platform and a system to control the implementing means of said bridge.

8. The system according to claim 7, wherein said communication means is selected from the group consisting of a fixed, an ultrasound, a sound, a luminous beam, an infrared link, and a radio wave type.

9. The system according claim 1, wherein said control post is located in an armored vehicle or a technical shelter.

* * * * *